US006213457B1

(12) United States Patent
Schlough

(10) Patent No.: US 6,213,457 B1
(45) Date of Patent: Apr. 10, 2001

(54) APPARATUS AND METHOD FOR FEEDING SHEET MATERIAL MAGAZINES

(75) Inventor: James Richard Schlough, Troy, OH (US)

(73) Assignee: Heidelberger Druckmaschinen, Heidilberg (DE)

( * ) Notice: Subject to any disclaimer, the term of this patent is extended or adjusted under 35 U.S.C. 154(b) by 0 days.

(21) Appl. No.: 09/222,148

(22) Filed: Dec. 29, 1998

(51) Int. Cl.[7] ..... B65H 39/04

(52) U.S. Cl. ..... 270/58.23; 270/52.14; 270/52.16; 270/52.2; 270/52.22; 270/58.29; 271/184; 271/225; 271/205; 271/206; 271/294

(58) Field of Search ..... 270/52.14, 52.16, 270/52.19, 52.2, 52.21, 52.22, 58.19, 58.23, 58.26, 58.29; 271/204, 205, 206, 287, 292, 294, 225, 184; B65H 39/04

(56) References Cited

U.S. PATENT DOCUMENTS 3,819,173 6/1974 Anderson et al. .
4,606,173 * 8/1986 Meier ..... 271/204 X
4,801,036 * 1/1989 Rathert ..... 270/58.29
4,988,086 * 1/1991 Schlough ..... 270/52.2
4,989,850 2/1991 Weller .
5,213,318 * 5/1993 Newhall ..... 270/52.2
5,560,594 * 10/1996 Gosslinghoff ..... 270/52.24
5,921,538 * 7/1999 Schlough ..... 270/52.18
5,979,888 * 11/1999 Schlough ..... 270/58.21

* cited by examiner

*Primary Examiner*—Christopher P. Ellis
*Assistant Examiner*—Patrick Mackey
(74) *Attorney, Agent, or Firm*—Herbert L. Lerner; Laurence A. Greenberg; Werner H. Stemer

(57) ABSTRACT

An apparatus for feeding flat products from a pile of flat products to a receiving location especially on a conveyor includes a plurality of delivering units for extracting a single flat product from the pile. Each of the delivering units has a first driven belt and is engageable with a pile. Furthermore, the apparatus includes a diverting element for diverting the flat products in a predetermined direction. A method of operating the apparatus is also provided.

20 Claims, 6 Drawing Sheets

APPARATUS AND METHOD FOR FEEDING SHEET MATERIAL MAGAZINES

BACKGROUND OF THE INVENTION

Field of the Invention

This invention relates broadly to the production of print media such as magazines, books, catalogues and the like, and more specifically to the production of different issues or groups of magazines within a total national subscription of a magazine.

For the purpose of this disclosure, reference will hereinafter be made to "magazine" or "magazines" with the understanding that the term is to be considered generic to magazines, books, catalogues and the like. In magazine publishing, there is an increasing desire by advertisers to direct their advertising at particular subscriber groups within a total national subscription of a magazine. To meet this demand the magazine publisher has to provide different issues of magazines containing different combinations of advertising for different subscriber groups which accordingly requires that the magazines of one total national subscription are to be made up of different combinations of signatures.

A typical magazine assembly system for solving this problem is for example disclosed in U.S. Pat. No. 3,819,173 which describes a method and an apparatus for producing magazines. The apparatus comprises an inserter having a plurality of pockets arranged aside a collating chain and adapted to contain different sets of signatures which are to be delivered to the collating chain. Each of the inserter pockets is provided with a feeder mechanism which may be selectively engaged or disengaged to enable or prevent the feeding of the signature from the associated pocket feed mechanism to the collating chains. This selective feeding of signatures from a plurality of hoppers makes it possible to produce different issues of magazines of one edition.

From U.S. Pat. No. 4,988,086, a collating apparatus for producing magazines is known. This document describes an apparatus for forming sheet material assemblages where a continuous path of sequentially arranged pockets travels beneath a plurality of piles of sheets, each pile being arranged in a bottomless hopper. Each of the pockets comprises a belt mechanism to extract one of the sheet materials from the piles when it passes beneath the pile and to feed it into the receiving pocket.

As the number of hoppers which can be arranged along the conveyor is limited due to the limited length of the conveyor, this heretofore known method and apparatus is considerably limited, however, in its ability to add any number of different signatures to the magazine.

U.S. Pat. No. 4,989,850 discloses a machine for collating signatures on a conveyor, where the individual magazines which are to be produced are provided with the name and address of the subscriber on the inside of a so called demographic signature. To deliver such a signature to a main conveyor it is suggested to provide the machine with a remote conveyor, a so-called raceway, which delivers individual and personalized signatures from a remote signature magazine to the main conveyor. The signatures are fed from the remote magazine to the raceway using an extracting cylinder comprising a pair of discs mounted on a common shaft. The signatures are identical in geometry and have the same preprinted text. During traveling on the raceway the signatures are personalized by an ink jet printer. Furthermore, it is possible to provide two pocket feeders for delivering different signatures onto the raceway depending on so-called demographic orders which refer to different interests of the reader, for example.

SUMMARY OF THE INVENTION

It is an object of the invention of the instant application to provide a new and improved apparatus for feeding sheet material such as signatures or sheets onto a conveyor such as a belt conveyor, especially for use in the production of magazines.

It is a further object of the invention to provide a new and improved apparatus for producing magazines having personalized or customized pages.

It is yet another object of the invention to provide a new and improved method of operating the apparatus.

According to one aspect of the invention, the apparatus for feeding a flat product from a pile of flat products to a receiving location on a conveyor includes a plurality of delivering units moving in a closed loop along a path extending at least partly beneath the pile for extracting a single flat product from the pile. Each of the delivering units has a first driven belt which is engageable with the pile and has a diverting element for diverting the flat product in a predetermined direction.

According to another aspect of the invention, there is provided an apparatus for forming sheet material assemblages having a main conveyor and receiving locations located on the main conveyor. A number of the remote sheet material magazines for holding piles of sheet material and a remote delivering unit for delivering sheet material from the remote sheet material magazines to the main conveyor is arranged. The remote delivering unit comprises a remote feeder conveyor having a plurality of receiving locations located thereon. A plurality of delivering units for moving one of the sheet material of one of the piles to one of the receiving locations of the remote feeder conveyor is arranged. The delivering units move independently from the remote feeder conveyor along a path in a closed loop. Each of the delivering units includes a first driven belt having an upper run sequentially engageable with each of the piles of sheet material. A driving unit moves each of the plurality of delivering units past each of the sheet material magazines, wherein each of the delivering units includes a sheet diverting element for diverting the sheet material in a predetermined direction in order to feed the sheet material to the receiving location on the remote feeder conveyor.

According to a further aspect of the invention, a method for feeding a flat product from a pile of flat products to a receiving location includes the steps of moving a plurality of delivering units past the pile, each of the delivering units including a belt and a diverting element. The method further comprises the steps of extracting a single flat product from the pile with one of the plurality of delivering units, diverting the flat product with a diverting unit of the delivering unit and feeding the flat product to the receiving location.

The provision of the diverting element for diverting a sheet material being fed from a pile of flat products to a receiving location, preferably on a conveyor, by one of the plurality of delivering units makes it possible to use a fast feeding technology to feed single sheet materials onto a conveyor, especially a conveyor belt.

The foregoing and other objects and features of the invention will become more apparent upon a consideration of the following description taken into connection with the accompanying drawings wherein:

DESCRIPTION OF THE PREFERRED EMBODIMENTS

Figure 1:
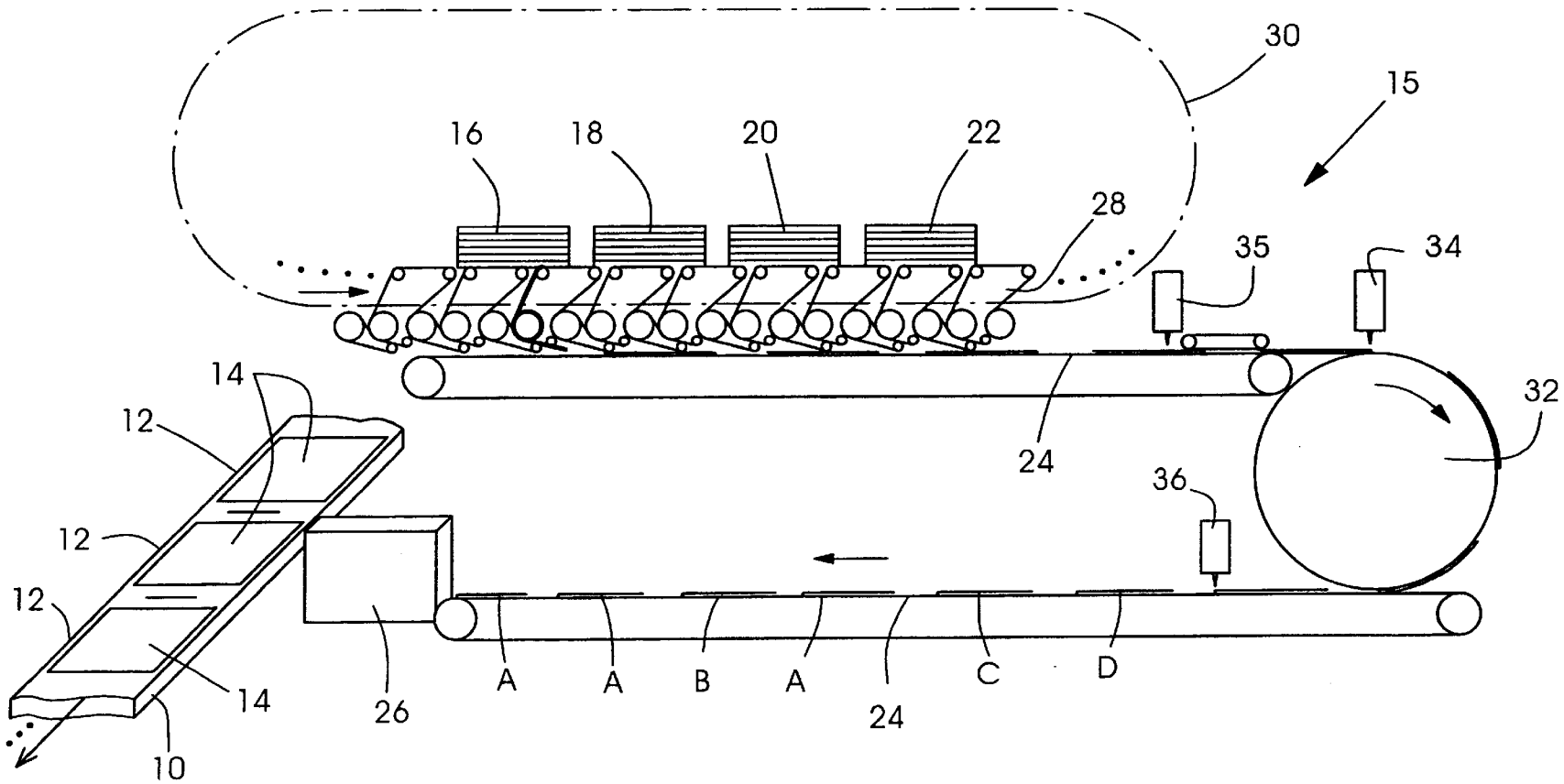
FIG. 1 is a diagrammatic and schematic side-elevational, partly perspective view of a floor arrangement of an apparatus according to the invention of the instant application.

Referring now more in detail to the drawings and particularly to FIG. 1, there is shown therein an apparatus according to the invention of the instant application which includes a main conveyor 10 having receiving locations 12 located thereon for receiving flat products 14 such as sheet material, especially sheets or signatures. A plurality of hoppers (not shown) may be arranged along the main conveyor 10 to feed individual signatures from each of the hoppers to the main conveyor in order to build up a book block which is to be bound and trimmed in order to form a magazine.

For producing different issues of magazines containing different combinations of advertising for different subscriber groups it is necessary to feed different types of sheet material e.g. "A", "B", "C" and "D" to the main conveyor. These different sheet materials comprise different printing or advertising and are determined for different issues of one magazine and may even differ in size. Each of the different sheet materials A, B, C and D is stored in remote sheet material magazine 16, 18, 20, 22 and is fed from the material magazine to a remote feeder conveyor 24 which transports the individual sheets to the main conveyor 10. The individual sheets A, B, C and D may be fed by the remote feeder conveyor 24 to the main conveyor 10 via a conventional feeding mechanism 26 which is known for example from U.S. Pat. No. 4,989,850 or U.S. Pat. No. 3,819,173. The material magazines 16, 18, 20, 22 holding a pile of individual signatures or sheets may be of any number but are preferably of up to four as shown in FIG. 1. The magazines are preferably bottomless and the required signature is drawn from the corresponding magazine by a plurality of delivering feeder units 28 which are arranged in a closed loop and move along a predetermined path 30 but independently from the remote feeder conveyor 24. The remote feeder conveyor 24 moves the individual sheets or signatures A, B, C or D to the main conveyor 10 directly or as shown in FIG. 1 via a reversing drum 32 which causes the signatures to turn. The individual signatures are transported on the remote feeder conveyor 24 at predetermined receiving locations 13 (FIG. 2, for example) and may be fed to one or more printing stations where printers, e.g. ink jet printers 34, 35 print individual data onto the signatures such as the name or the address of the subscriber of the magazine. This printing stations may be arranged at any location along the path of the remote feeder conveyor 24. Therefore, each individual signature may be ink printed while being transported in horizontal orientation via a properly arranged ink jet or, as shown in FIG. 1 by a printing station 34, on the transfer drum 32 while being bound on the drum. In addition to the embodiment wherein two or more printing stations are arranged upstream or above the transfer drum 32 it is possible to arrange a printing station 36 downstream from the drum 32, where the individual signature has been turned already. This makes it possible to provide even the backside of the signature 14 with individual or additional printed information.

The remote delivery unit 15 delivers different kinds of signatures A, B, C, D to the main conveyor 10. It includes a remote feeder conveyor 24 as well as a plurality of delivering units 28 for moving one of the individual signatures A, B, C, D of one of the piles 16, 18, 20, 22 to one of the receiving locations 13 located on the remote feeder conveyor 24 as shown in greater detail in FIG. 2.

Figure 2:
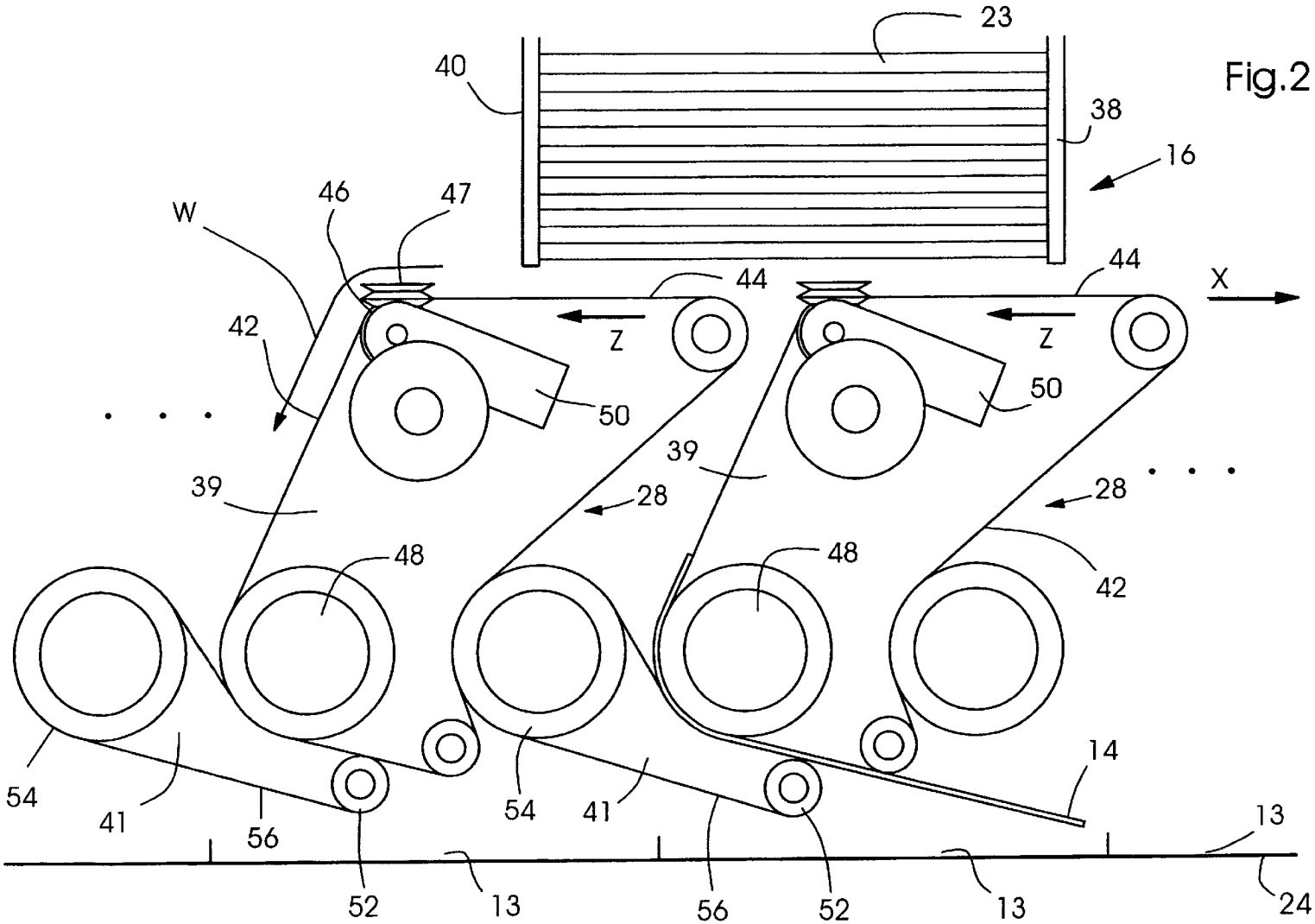
FIG. 2 is a diagrammatic and schematic side-elevational view of the feeders for moving sheet material from a pile to a receiving location according to the invention.

Each of the remote sheet material magazines 16, 18, 20, 22 has two side walls 38, 40, as shown in FIG. 2, which hold the pile of sheet material 23 and the preferably bottomless magazine 16. A plurality of delivering units 28 are arranged beneath the magazine 16 and may be linked together so that they move along a predetermined continuous path 30 which partly extends beneath the stationary arranged bottomless sheet material magazines 16, 18, 20, 22. The remote feeder units 28 are preferably of the same construction and include a separating part 39 for separating a single sheet material 14 from the pile of sheet material 23 and a diverting part 41 for diverting the single sheet material onto a predetermined direction. Each of the remote feeder units 28 preferably comprises a driven belt 42 having an upper run 44 supporting the pile 23 of the sheet material magazine 16. The uppers runs 44 of the belts 42 move in the direction indicated by the arrow "Z" which is opposite to the direction of movement of the delivering units 28 relative to the sheet material magazine 16, which is indicated by the arrow "X". The velocity of the upper runs 44 and the velocity of the movement of the delivering units 28 is preferably substantially the same so that a fixed point on the upper run 44 of the belt 42 is stationary relative to the remote sheet material magazine 16.

The remote feeder conveyor 24 may move in the same direction as the remote feeder units 28, indicated by the arrow "X". As soon as a trailing edge 46 of one of the separating parts 39 passes the side wall 40, a sucker 47 can be activated in order to draw the lowermost signature from the bottom of the pile 23 downwardly. Whenever a single sheet material shall be drawn from the bottom of the pile 23 the sucker 47 will be activated. The feeding action of the sucker can be selectively controlled either by engagement of motion, e.g. a calm drive, or by activating and deactivating a vacuum, applied to the sucker 47. When activated, the sucker 47 draws a sheet material from the bottom of the pile of sheet materials 23 downwardly and, according to the movement of the belt 42, the sheet material 14 is drawn in the direction given by the arrow "W". When the sheet material 14 enters the diverting part 41 of the remote delivering unit 28, its direction is diverted to a direction substantially parallel to the moving direction of the remote feeder conveyor 24.

The sucker 47 guides the leading edge of the sheet material 14 around the primary belt pulley 42 and releases it after one half turn of the sucker shaft 50. The sheet material now travels downwardly and the direction of movement is subsequently changed when the leading edge of the sheet material enters the diverting part 41 of the delivering unit 28. The diverting part 41 comprises two rollers 52 and 54, and a second belt 56 travelling around the rollers 54 and 52. The second belt 56 is engaged with a lower roller 48 of the separating part of the delivering unit 28, and the second roller 52 of the diverting part 39 is engaged with the first belt 42 of a separating part of a succeeding delivering unit. This engaged construction of the belts and rollers makes it possible to keep the individual delivering units in close contact with each other and therefore it is possible to arrange the units 28 a small distance from one another.

The second belt 56 of each diverting part 41 is driven independently from the delivering unit 28 and the drive of the first belt 42 but preferably is driven at the velocity of the units. When the leading edge of the sheet material enters the nip between the first belt 42 and the second belt 56 it is trapped between the two belts and fed to the remote feeder conveyor 24 where it is laid on the receiving location 13 and transported to the main conveyor 10.

Figure 3:
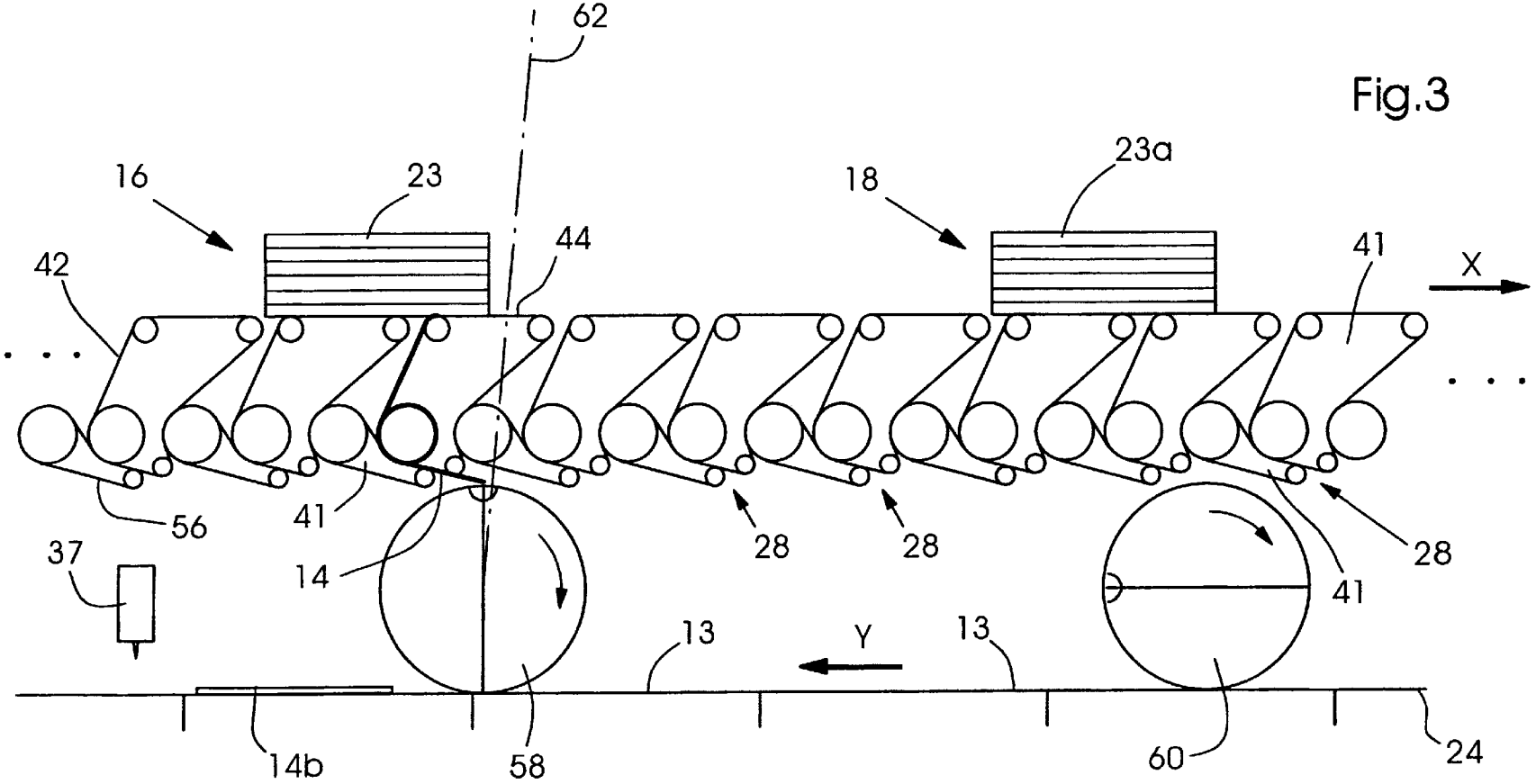
FIG. 3 is a diagrammatic and schematic side-elevational view of a part of the remote delivery unit according to the invention.
Figure 4:
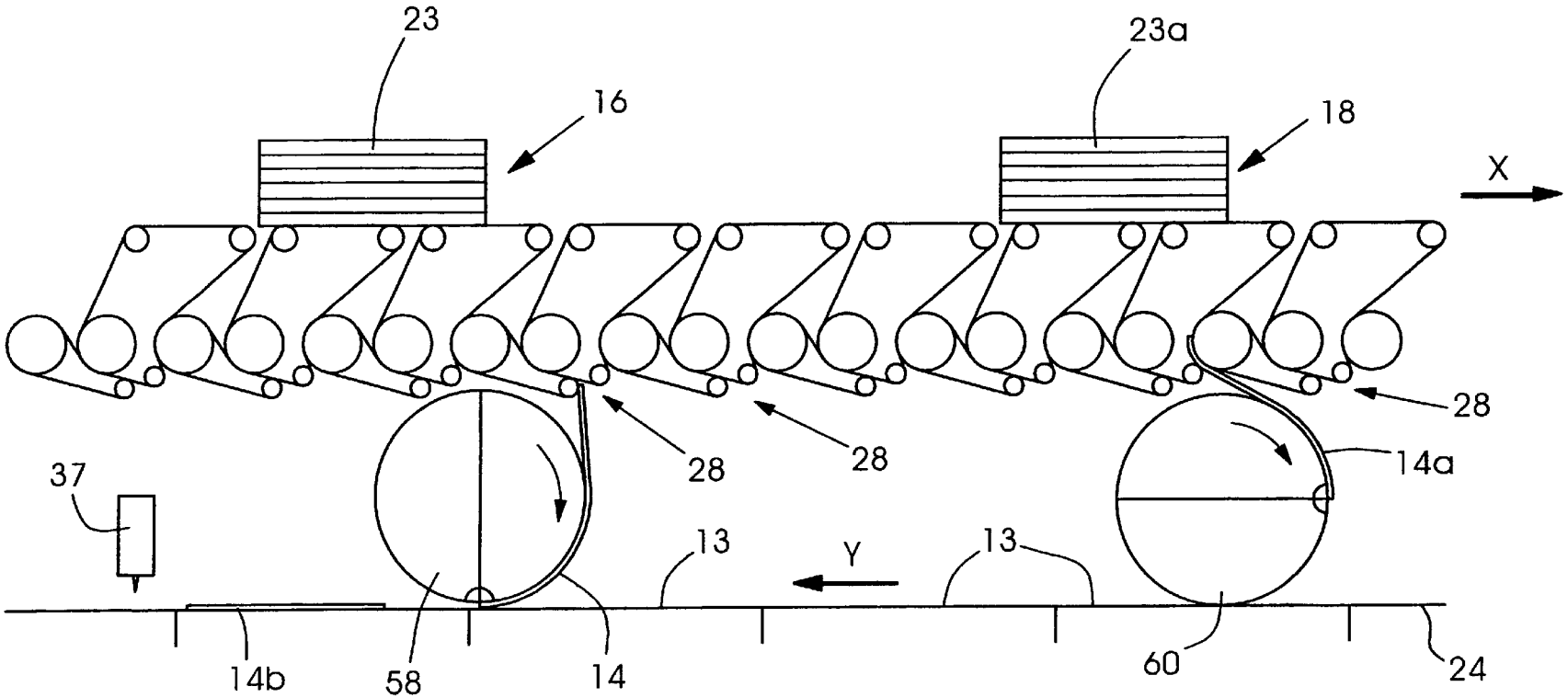
FIG. 4 is a view like that of FIG. 3 depicting the movement of a sheet material from a pile to a receiving location on a conveyor.
Figure 5:
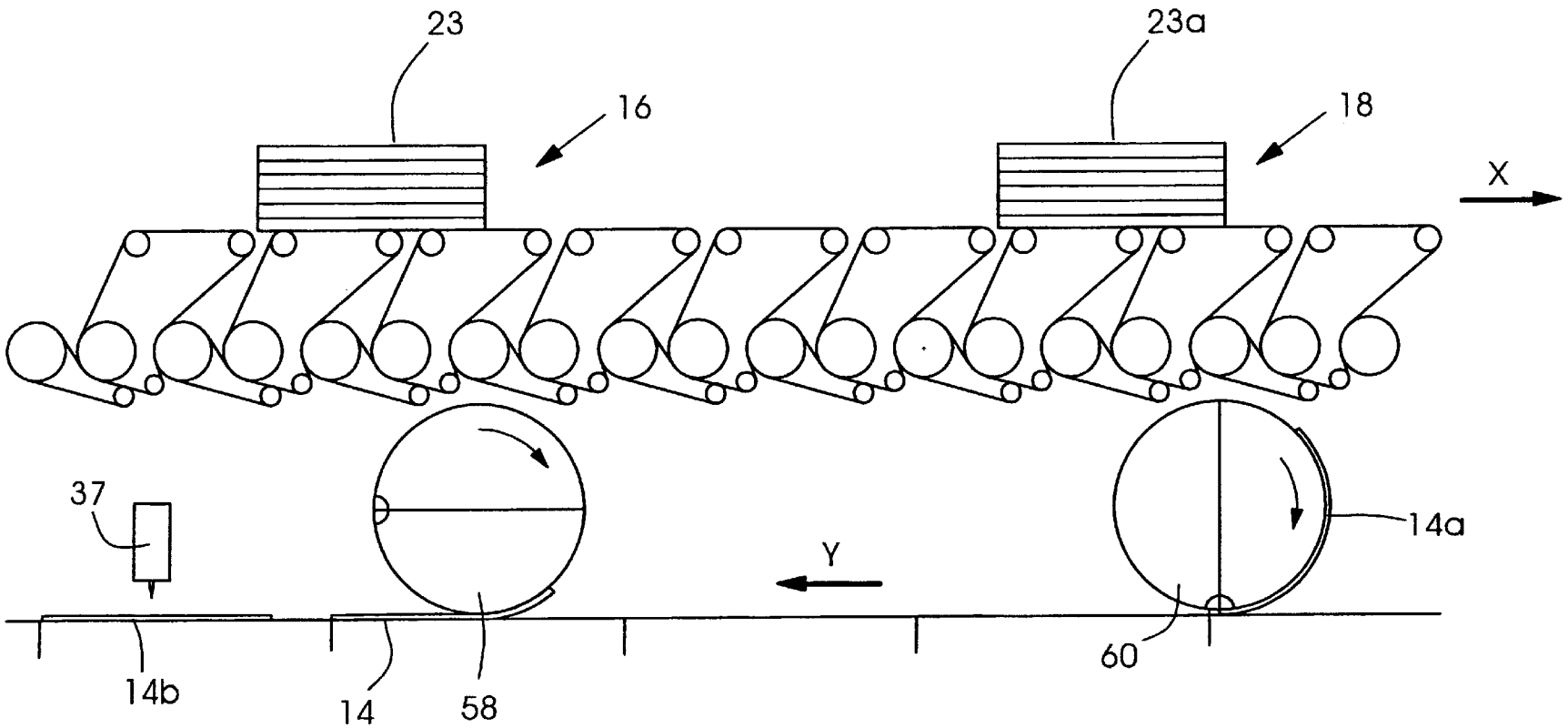
FIG. 5 is a view like that of FIG. 4, in another operating phase of the apparatus according to the invention depicting the movement of a sheet material from a pile to a receiving location on a conveyor.

In another embodiment of the invention of the instant application which is shown in FIGS. 3 to 5, the individual sheet material is fed from a pile of sheet materials 23 to a receiving location 13 on the remote feeder conveyor 24 with gripper drums 58, 60. As shown in FIG. 3 an individual sheet material is drawn from the bottom of a pile of sheet materials 23 as described above. The plurality of delivering units 28, the so-called carriages, which move in continuous path, include a diverting part 41 and a separating part 39. They move beneath piles of sheet material 23, 23*a* in the direction given by the arrow "X". A vacuum mechanism grabs the leading edge of a lowermost individual signature 14 when a carriage passes under and draws the signature 14 into the carriage. According to the relative movement of the carriages 28 and the upper run 44 of the belt 42 the signature 14 is peeled into the carriage and diverted by the diverting element 41 of the carriage 28. As the belts 42 and 56 are preferably driven at the same speed as the carriages move, the signature 14 is passed through the carriage and ejected at the bottom of the carriage at twice the linear velocity of the carriage and fed tangentially to a rotating gripper drum 58. The gripper drum 58 is rotating in the direction of the paper flow, the surface speed of the drum being preferably greater than the linear speed of the paper. To perform sufficient gripping and feeding of the individual signature 14 by the gripper drum 58, the gripper drum 58 has a surface speed which is 10% greater than that of the linear speed of the paper. Preferably, the signature 14 is gripped by the gripper drum 58 when the gripper, mounted on the gripper drum 58, has reached a position approximately 5° past its upper position which is indicated by the dot-dash or phantom line 62.

Upon further rotation of the gripper drum 58, the signature 14 is fed from the carriage 28 to a receiving location 13 on the remote feeder conveyor 24 whereat the gripper drum 58 rotates about 175° further, as is shown in FIG. 4. To determine if a correct feeding of a single signature 14 has occurred it is possible to measure the thickness of the signature 14 using calipers (not shown) during the rotation of the drum 58. During the movement of the gripper drum 58, an additional gripper drum 60 may proceed with feeding a signature 14*a* from a pile of signatures 23*a* to another receiving location 13 of the remote feeder conveyor 24. Thus, it is possible to feed different individual signatures from different piles of signatures to the remote feeder conveyor 24 which transports these signatures to a main conveyor.

As shown in FIG. 5, a printer 37 which may be arranged downstream in the feeding direction of the remote feeder conveyor 24 starts to print information onto the signature as soon as it reaches a position beneath the printer 37 which is indicated by the position of signature 14*b*. The information printed on the signature may be of any type, especially of any individual type such as the subscriber's name or address. In addition or instead of these individual data, the information which is printed on the individual signature 14 may comprise some latest information which has not been known during the previous printing of the individual signatures 14.

Figure 6:
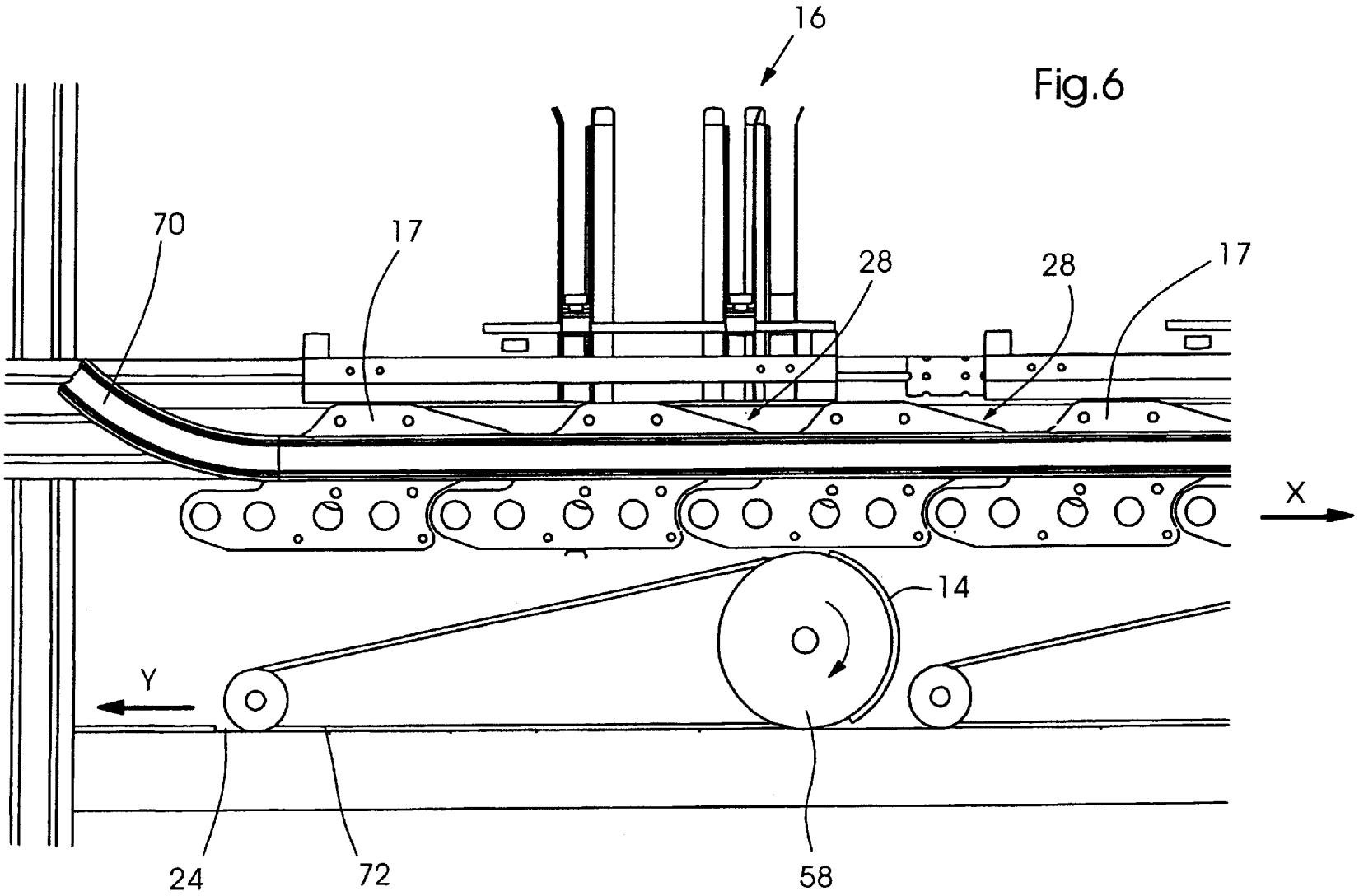
FIG. 6 is a structural side-elevational view of a feeding apparatus according to the invention.

In FIG. 6, a more detailed side view of a feeding apparatus according to the invention is shown. The plurality of delivering unit 28, the so-called carriages, are arranged in a housing 17 and move in a continuous loop along a rail 70. As already described hereinabove, a gripper mounted on the gripper drum 58 grips the leading edge of a signature as soon as it comes out from the bottom of the carriages 28. The signature 14 is set directly into the gripper of the gripper drum 58. At this time, the control of movement of the signature 14 is transferred from the belts of the carriages to the gripper drum. The gripper drum carries the signature around while reversing the original direction of movement "X", which corresponds to the direction of movement of the carriages into the direction of movement "Y" of the feeder conveyor 24. The gripper drums 58 which are preferably belt-driven may be formed with a groove for receiving a belt 72 therein, the groove being sized so that the outside diameter of the belt is flush with the surface of the drum. The belt 72 may be of any suitable kind of material, but preferably is a round polyurethane belting. The belt 72 leaves the drum tangentially at the end of the drum facing towards the feeder conveyor 24 and guides the feeder 24 substantially parallel, thereby forming an upper belt with respect to the feeder conveyor 24. After a signature 14 has been carried around by a gripper drum 58, it is released into the nip between the gripper drum and the feeder conveyor 24 which preferably is of a transport belt type. When the gripper drum 58 releases the signature 14, it is clamped between the upper belt 72 and the lower conveyor belt 24 and transported in the direction "Y" which is the direction of movement of the feeder conveyor 24. Once trapped within the nip of the upper belt 72 and the feeder conveyor 24 the signature may be transported to an ink jet module where it will be ink jetted and transported to a main conveyor. Although the feeding mechanism of the invention has been described in connection with the remote feeder conveyor it is also possible to use this principle of feeding of signatures from a pile of signatures to a feeder conveyor, especially a belt feeder conveyor in a main conveyor.

Without further analysis, the foregoing will so fully reveal the gist of the invention of the instant application that others can by applying current knowledge readily adapt it to various applications without omitting features that, from the standpoint of prior art, fairly constitute essential characteristics of the generic or specific aspects of this invention and, therefore such adaptations should and are intended to be comprehended within the meaning and range of equivalence of the following claims.

I claim:

1. An apparatus for feeding a flat product from a pile of flat products to a conveyor, comprising a plurality of delivering units movable in a closed loop along a path extending at least partly beneath the pile, for extracting a single flat product from the pile, each of said delivering units having a first driven belt being engageable with the pile, and a diverting element engageable with said first belt for diverting the flat products in a predetermined direction.

2. The apparatus according to claim 1, wherein said diverting element comprises a second belt engageable with said first belt.

3. The apparatus according to claim 1, wherein the flat product is a sheet material, and wherein said diverting element is disposed so as to divert the sheet material substantially parallel to the direction of a remote feeder conveyor.

4. The apparatus according to claim 1, further comprising a gripper drum for gripping and rotating the flat product after it has been diverted by said diverting element.

5. The apparatus according to claim 1, including a gripper drum belt rotating around said gripper drum.

6. The apparatus according to claim 5, wherein said belt has a surface flush with the surface of said gripper drum.

7. The apparatus according to claim 5, wherein said belt is a polyurethane belting.

8. An apparatus for forming sheet material assemblages, comprising a main conveyor having receiving locations located thereon for receiving sheet material, a plurality of remote sheet material magazines for holding piles of sheet material, a remote delivery unit for delivering sheet material from said plurality of remote sheet material magazines to said main conveyor, said remote delivery unit including a remote feeder conveyor having a plurality of receiving locations located thereon, a plurality of remote feeder units movable independently of said remote feeder conveyor along a path in a closed loop for feeding one of the sheet material of one of the piles to one of the receiving locations on the remote feeder conveyor, each of said remote feeder units including a first driven belt having an upper run sequentially engageable with each of the piles of the sheet material, each of said remote feeder units further including a sheet diverting element engageable with said first belt for diverting the sheet material in a predetermined direction in order to feed the sheet material to said receiving location on said remote feeder conveyor.

9. The apparatus according to claim 8, wherein each of said diverting elements comprises a second belt engageable with said first belt.

10. The apparatus according to claim 8, wherein said diverting element diverts the sheet material substantially parallel to the direction of said remote feeder conveyor.

11. The apparatus according to claim 8, wherein said remote delivery unit comprises a gripper drum for gripping the sheet material from said diverting element.

12. The apparatus according to claim 11, wherein said gripper drum is rotatable in the direction of the run of said remote feeder conveyor.

13. The apparatus according to claim 11, wherein said remote delivery unit includes a clamping belt, and said gripper drum is formed with a surface having a recess for receiving said clamping belt therein.

14. The apparatus according to claim 13, wherein said clamping belt in said recess is flush with the surface of said gripper drum.

15. The apparatus according to claim 8, wherein said remote delivery unit further comprises a reversing drum arranged along the path of said remote feeder conveyor for reversing the sheet material.

16. The apparatus according to claim 8, wherein said remote delivery unit further comprises a printer unit for printing individual data onto the sheet material.

17. The apparatus according to claim 16, wherein said remote delivery unit further comprises a reversing drum arranged along the path of said remote feeder conveyor for reversing the sheet material, and a second printing unit for printing individual data onto the reverse side of the sheet material.

18. A method for feeding a flat product from a pile of flat products to a receiving location, which comprises the steps of a) moving a plurality of delivering units past the pile, each of the delivering units including a separating element and a diverting element, b) extracting a single flat product from the pile with the separating element, c) diverting the flat product with the diverting element, d) feeding the flat product to the receiving location, and e) engaging the diverting element with the separating element.

19. The method according to claim 18, wherein the step d) comprises the steps of f) transmitting the flat product from the delivering unit to a gripper drum, and g) rotating the flat product on the gripper drum and releasing it on the receiving location.

20. The method according to claim 19, which includes reversing the direction of flow of the flat product during the step of rotating.

* * * * *